US011817035B2

(12) United States Patent
Zhao et al.

(10) Patent No.: US 11,817,035 B2
(45) Date of Patent: Nov. 14, 2023

(54) CHARGING TIME MODULATING METHOD AND DEVICE

(71) Applicant: Shenzhen China Star Optoelectronics Semiconductor Display Technology Co., Ltd., Guangdong (CN)

(72) Inventors: Jun Zhao, Guangdong (CN); Xiang Gao, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 499 days.

(21) Appl. No.: 17/051,446

(22) PCT Filed: Apr. 22, 2020

(86) PCT No.: PCT/CN2020/086076
§ 371 (c)(1),
(2) Date: Oct. 29, 2020

(87) PCT Pub. No.: WO2021/189579
PCT Pub. Date: Sep. 30, 2021

(65) Prior Publication Data

US 2023/0162649 A1 May 25, 2023

(30) Foreign Application Priority Data

Mar. 22, 2020 (CN) ..... 202010204846.2

(51) Int. Cl.
*G09G 3/20* (2006.01)

(52) U.S. Cl.
CPC ... *G09G 3/2092* (2013.01); *G09G 2310/0251* (2013.01); *G09G 2310/08* (2013.01); *G09G 2320/0223* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 11,315,517 | B2 * | 4/2022 | Watanabe | G09G 3/2096 |
| 11,545,066 | B2 * | 1/2023 | Guo | G09G 3/3291 |
| 2010/0277401 | A1 | 11/2010 | Takahara et al. | |
| 2012/0300164 | A1 | 11/2012 | Shimoshikiryoh | |
| 2014/0015821 | A1 * | 1/2014 | Hwang | G09G 3/20 345/211 |

(Continued)

FOREIGN PATENT DOCUMENTS

| | | |
|---|---|---|
| CN | 101246666 | 8/2008 |
| CN | 101510034 | 8/2009 |

(Continued)

*Primary Examiner* — Sepehr Azari

(57) ABSTRACT

A charging time modulating method is disclosed. After obtaining relational data between a charging rate and a charging time of pixel units on each pixel area, an average charging time corresponding to a preset charging rate is calculated based on each relational data. Then, an initial charging time of the pixel units on each of the pixel areas is obtained, and the initial charging time of the pixel units on each of the pixel areas is adjusted according to the average charging time, so that the initial charging time of the pixel units on each of the pixel areas is equal to the average charging time.

13 Claims, 8 Drawing Sheets

(56) References Cited

U.S. PATENT DOCUMENTS

| | | | | |
|---|---|---|---|---|
| 2014/0085274 | A1 | 3/2014 | Lewis | |
| 2016/0372071 | A1 | 12/2016 | Ho et al. | |
| 2018/0090094 | A1* | 3/2018 | Jung | G09G 3/3688 |
| 2018/0330655 | A1 | 11/2018 | Tsuchi et al. | |
| 2019/0237031 | A1* | 8/2019 | Cho | G09G 3/3677 |
| 2019/0279583 | A1* | 9/2019 | Shang | G09G 3/3611 |
| 2019/0340989 | A1 | 11/2019 | Lec et al. | |
| 2020/0168175 | A1* | 5/2020 | Tsuchi | G09G 3/3291 |
| 2020/0175910 | A1* | 6/2020 | Kim | G09G 3/2007 |
| 2021/0287627 | A1* | 9/2021 | Choi | G09G 3/3291 |

FOREIGN PATENT DOCUMENTS

| | | |
|---|---|---|
| CN | 104798125 | 7/2015 |
| CN | 105629539 | 6/2016 |
| CN | 106257578 | 12/2016 |
| CN | 106297712 | 1/2017 |
| CN | 108962110 | 12/2018 |
| CN | 110085178 | 8/2019 |
| KR | 100638304 | 10/2006 |
| KR | 10-2015-0035109 | 4/2015 |

* cited by examiner

CHARGING TIME MODULATING METHOD AND DEVICE

RELATED APPLICATIONS

This application is a National Phase of PCT Patent Application No. PCT/CN2020/086076 having International filing date of Apr. 22, 2020, which claims the benefit of priority of Chinese Patent Application No. 202010204846.2 filed on Mar. 22, 2020. The contents of the above applications are all incorporated by reference as if fully set forth herein in their entirety.

FIELD AND BACKGROUND OF THE INVENTION

The present application relates to the field of display technology, and particularly, to a charging time modulating method, device, storage medium, and electronic equipment.

A method used for modulating charging time of existing display panels is to increase charging time of a far end pixel unit, reduce charging time of a near end pixel unit, and change charging time of a middle pixel unit linearly. Among them, the near end refers to an end close to an output of a data signal, and the far end refers to an end far from an output of a data signal. However, the existing charging time modulating method can only achieve the near end and far end charging rate balance. Due to internal delay and non-linear change of the display panels, if the charging time of the middle pixel unit changes linearly, a charge rate of the near end pixel unit and the far end pixel unit will be good, while a charge rate of the middle pixel unit will be poor, resulting in poor display quality of the display panels.

For example, please refer to FIG. 1, which is a schematic diagram of a charging effect of an existing display panel. As shown in FIG. 1, due to a large number of pixels in the high-resolution display panel, uneven charging causes display effect of the display panel to be better at top and bottom, wherein upper and lower areas A and C are better, while middle area C is poorer. Hence, charging time needs to be modulated.

SUMMARY OF THE INVENTION

An embodiment of the present application provides a charging time modulating method, device, storage medium, and electronic equipment, which can improve display uniformity and display quality of a display panel.

In a first aspect, the embodiment of the present application provides a charging time modulating method, configured to modulate charging time of a display panel, wherein the display panel comprises a plurality of pixel areas arranged along a first direction, and each of the pixel areas comprises a plurality of pixel units arranged along a second direction, wherein the charging time modulating method comprises steps of:

obtaining relational data between a charging rate and a charging time of the pixel units on each of the pixel areas;

calculating an average charging time corresponding to a preset charging rate based on the relational data between the charging rate and the charging time of the pixel units on each of the pixel areas;

obtaining an initial charging time of the pixel units on each of the pixel areas; and adjusting the initial charging time of the pixel units on each of the pixel areas according to the average charging time, so that the initial charging time of the pixel units on each of the pixel areas is equal to the average charging time;

wherein the step of obtaining the relational data between the charging rate and the charging time of the pixel units on each of the pixel areas comprises:

obtaining the charging time and the charging rate of each of the pixel units on each of the pixel areas; and according to the charging time and the charging rate of each of the pixel units on each of the pixel areas, generating the relational data between the charging rate and the charging time of the pixel units on the corresponding pixel area; and the step of calculating the average charging time corresponding to the preset charging rate based on the relational data between the charging rate and the charging time of the pixel units on each of the pixel areas comprises:

obtaining the preset charging rate;

obtaining the charging time corresponding to the preset charging rate of the pixel units on each of the pixel areas according to the relational data between the charging rate and the charging time of the pixel units on each of the pixel areas; and calculating the average charging time based on the charging time corresponding to the preset charging rate of the pixel units on each of the pixel areas.

In the charging time modulating method described in the embodiment of the present application, the step of obtaining the preset charging rate comprises:

obtaining the preset reference charging rate;

when the relational data between the charging rate and the charging time of the pixel units on each of the pixel areas comprise the preset reference charging rate, taking the preset reference charging rate as the preset charging rate; and when the relational data between the charging rate and the charging time of the pixel units on at least one of the pixel areas do not comprise the preset reference charging rate, adjusting the preset reference charging rate, and returning to the step of obtaining the preset reference charging rate.

In the charging time modulating method described in the embodiment of the present application, the step of adjusting the initial charging time of the pixel units on each of the pixel areas according to the average charging time, so that the initial charging time of the pixel units on each of the pixel areas is equal to the average charging time, comprises:

comparing the initial charging time of the pixel units on each of the pixel areas with the average charging time;

when the initial charging time of the pixel units on the pixel area is less than the average charging time, increasing the initial charging time to obtain a compensation charging time, wherein the compensation charging time is equal to the average charging time; and when the initial charging time of the pixel units on the pixel area is greater than the average charging time, reducing the initial charging time to obtain the compensation charging time, and the compensation charging time is equal to the average charging time.

In a second aspect, the embodiment of the present application provides a charging time modulating method, configured to modulate charging time of a display panel, wherein the display panel comprises a plurality of pixel areas arranged along a first direction, and each of the pixel areas comprises a plurality of pixel units arranged along a second direction, wherein the charging time modulating method comprises steps of:

obtaining relational data between a charging rate and a charging time of the pixel units on each of the pixel areas;

calculating an average charging time corresponding to a preset charging rate based on the relational data between the charging rate and the charging time of the pixel units on each of the pixel areas;

obtaining an initial charging time of the pixel units on each of the pixel areas; and adjusting the initial charging time of the pixel units on each of the pixel areas according to the average charging time, so that the initial charging time of the pixel units on each of the pixel areas is equal to the average charging time.

In the charging time modulating method described in the embodiment of the present application, the step of obtaining the relational data between the charging rate and the charging time of the pixel units on each of the pixel areas comprises:

obtaining the charging time and the charging rate of each of the pixel units on each of the pixel areas; and according to the charging time and the charging rate of each of the pixel units on each of the pixel areas, generating the relational data between the charging rate and the charging time of the pixel units on the corresponding pixel area.

In the charging time modulating method described in the embodiment of the present application, the step of calculating the average charging time corresponding to the preset charging rate based on the relational data between the charging rate and the charging time of the pixel units on each of the pixel areas comprises:

obtaining the preset charging rate;

obtaining the charging time corresponding to the preset charging rate of the pixel units on each of the pixel areas according to the relational data between the charging rate and the charging time of the pixel units on each of the pixel areas; and calculating the average charging time based on the charging time corresponding to the preset charging rate of the pixel units on each of the pixel areas.

In the charging time modulating method described in the embodiment of the present application, the step of obtaining the preset charging rate comprises:

obtaining the preset reference charging rate;

when the relational data between the charging rate and the charging time of the pixel units on each of the pixel areas comprise the preset reference charging rate, taking the preset reference charging rate as the preset charging rate; and when the relational data between the charging rate and the charging time of the pixel units on at least one of the pixel areas do not comprise the preset reference charging rate, adjusting the preset reference charging rate, and returning to the step of obtaining the preset reference charging rate.

In the charging time modulating method described in the embodiment of the present application, the step of adjusting the initial charging time of the pixel units on each of the pixel areas according to the average charging time, so that the initial charging time of the pixel units on each of the pixel areas is equal to the average charging time, comprises:

comparing the initial charging time of the pixel units on each of the pixel areas with the average charging time;

when the initial charging time of the pixel units on the pixel area is less than the average charging time, increasing the initial charging time to obtain a compensation charging time, wherein the compensation charging time is equal to the average charging time; and when the initial charging time of the pixel units on the pixel area is greater than the average charging time, reducing the initial charging time to obtain the compensation charging time, and the compensation charging time is equal to the average charging time.

In a third aspect, the embodiment of the present application provides a charging time modulating device, configured to modulate charging time of a display panel, wherein the display panel comprises a plurality of pixel areas arranged along a first direction, and each of the pixel areas comprises a plurality of pixel units arranged along a second direction, wherein the charging time modulating device comprises:

a first acquiring module, wherein the first acquiring module is configured to obtain relational data between a charging rate and a charging time of the pixel units on each of the pixel areas;

a calculation module, wherein the calculation module is configured to calculate an average charging time corresponding to a preset charging rate based on the relational data between the charging rate and the charging time of the pixel units on each of the pixel areas;

a second acquiring module, wherein the second acquiring module is configured to obtain an initial charging time of the pixel units on each of the pixel areas; and an adjustment module, wherein the adjustment module is used to adjust the initial charging time of the pixel units on each of the pixel areas according to the average charging time, so that the initial charging time of the pixel units on each of the pixel areas is equal to the average charging time.

In the charging time modulating device described in the embodiment of the present application, the first acquiring module comprises:

a first acquiring unit, wherein the first acquiring unit is configured to obtain the charging time and the charging rate of each of the pixel units on each of the pixel areas; and a generating unit, wherein the generating unit is configured to generate the relational data between the charging rate and the charging time of the pixel units on the corresponding pixel area according to the charging time and the charging rate of each of the pixel units on each of the pixel areas.

In the charging time modulating device described in the embodiment of the present application, the calculation module comprises:

a second acquiring unit, wherein the second acquiring unit is configured to obtain the preset charging rate;

a third acquiring unit, wherein the third acquiring unit is configured to obtain the charging time corresponding to the preset charging rate of the pixel units on each of the pixel areas according to the relational data between the charging rate and the charging time of the pixel units on each of the pixel areas; and a calculation unit, wherein the calculation unit is configured to calculate the average charging time based on the charging time corresponding to the preset charging rate of the pixel units on each of the pixel areas.

In the charging time modulating device described in the embodiment of the present application, the second acquiring unit comprises:

an acquiring subunit, wherein the acquiring subunit is configured to obtain the preset reference charging rate;

a setting subunit, wherein the setting subunit is configured to take the preset reference charging rate as the preset charging rate when the relational data between the charging rate and the charging time of the pixel units on each of the pixel areas comprise the preset reference charging rate; and a return subunit, wherein the return subunit is configured to adjust the preset reference charging rate, and return to the acquiring subunit when the relational data between the charging rate and the charging time of the pixel units on at least one of the pixel areas do not comprise the preset reference charging rate.

In the charging time modulating device described in the embodiment of the present application, the adjustment module comprises:

a comparison unit, wherein the comparison unit is configured to compare the initial charging time of the pixel units on each of the pixel areas with the average charging time;

a first adjustment unit, wherein the first adjustment unit is configured to increase the initial charging time to obtain a compensation charging time when the initial charging time of the pixel units on the pixel area is less than the average charging time, and the compensation charging time is equal to the average charging time; and a second adjustment unit, wherein the second adjustment unit is configured to reduce the initial charging time to obtain the compensation charging time when the initial charging time of the pixel units on the pixel area is greater than the average charging time, and the compensation charging time is equal to the average charging time.

In a third aspect, the embodiment of the present application provides a storage medium on which a computer program is stored, and when the computer program is executed by a processor, the above charging time modulating method is implemented.

In a fourth aspect, the embodiment of the present application provides an electronic device, comprising a memory, a processor, and a computer program stored on the memory and executable on the processor, and when the processor executes the computer program, the above charging time modulating method is realized.

After obtaining the relational data between the charging rate and the charging time of the pixel units on each of the pixel areas in the embodiment of the present application, then, calculating an average charging time corresponding to a preset charging rate based on the relational data between the charging rate and the charging time of the pixel units on each of the pixel areas, then, obtaining an initial charging time of the pixel units on each of the pixel areas, and finally, adjusting the initial charging time of the pixel units on each of the pixel areas according to the average charging time, so that the initial charging time of the pixel units on each of the pixel areas is equal to the average charging time; since the embodiment of the present application adjusts the initial charging time of the pixel units on each of the pixel areas based on the data of the relationship between the charging rate and the charging time of the pixel units on each of the pixel areas, the charging time of the pixel units on each of the pixel areas can be debugged, thereby improving display uniformity and improving the display quality of the display panel.

BRIEF DESCRIPTION OF THE SEVERAL VIEWS OF THE DRAWINGS

In order to more clearly explain the technical solutions in the embodiments of the present application, the following will briefly introduce the drawings required in the description of the embodiments. Obviously, the drawings in the following description are only some embodiments of the present application. For those skilled in the art, without paying any creative work, other drawings can be obtained based on these drawings.

DETAILED DESCRIPTION OF PREFERRED SPECIFIC EMBODIMENTS OF THE INVENTION

The technical solutions in the embodiments of the present application will be described clearly and completely in conjunction with the drawings in the embodiments of the present application. Obviously, the described embodiments are only a part of the embodiments of the present application, but not all the embodiments. Based on the embodiments in the present application, all other embodiments obtained by those skilled in the art without making creative work fall within the protection scope of the present application.

Figure 1:
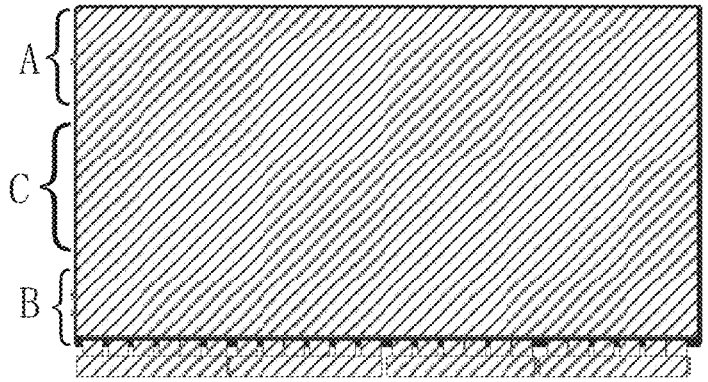
FIG. 1 is a schematic diagram of a charging effect of an existing display panel.
Figure 2:
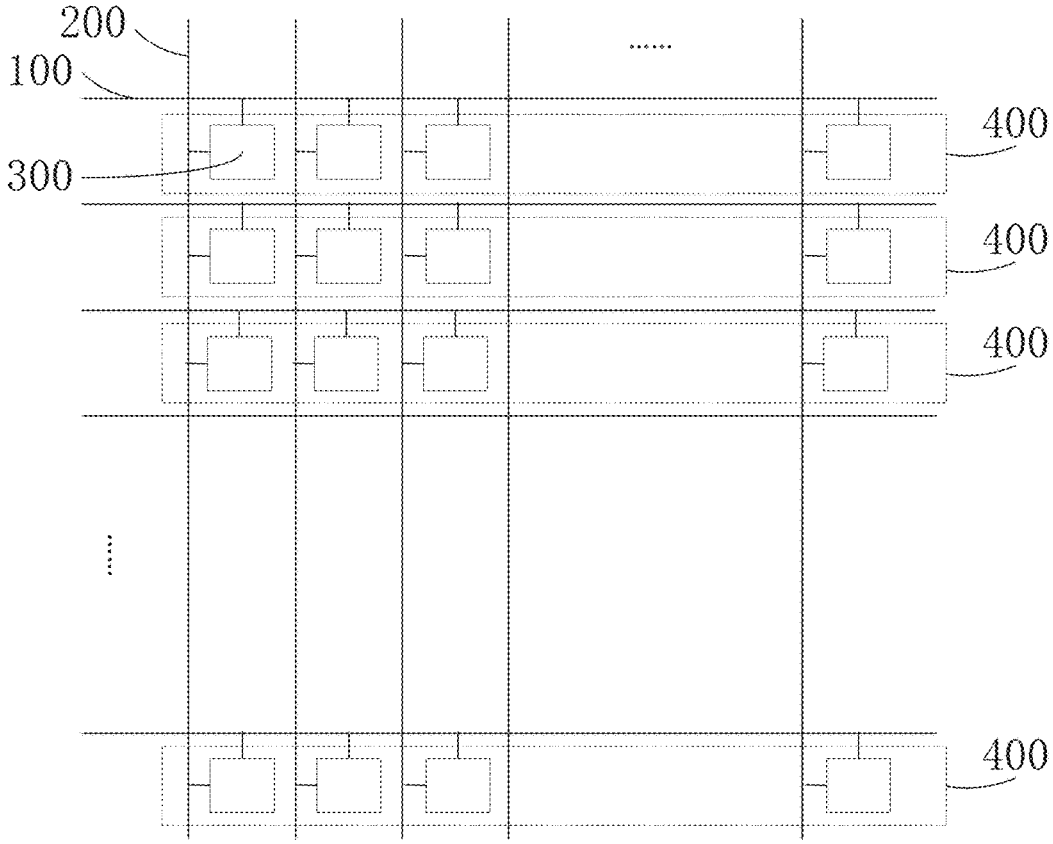
FIG. 2 is a schematic structural diagram of a display panel in a charging time modulating method provided by an embodiment of this application.

The embodiment of the present application provides a charging time modulating method, device, storage medium, and electronic equipment. Wherein, the charging time modulating method is used for modulating the charging time of the display panel. Please refer to FIG. 2, which is a schematic structural diagram of a display panel in a charging time modulating method provided by an embodiment of this application. As shown in FIG. 2, the display panel comprises a plurality of scan lines 100, a plurality of data lines 200, and a plurality of pixel units 300 defined by an intersection of the plurality of scan lines 100 and the plurality of data lines 200. It can be understood that the display panel comprises a plurality of pixel areas 400 arranged along a first direction, and each of the pixel areas 400 comprises a plurality of pixel units 300 arranged along a second direction.

It should be noted that, as shown in FIG. 2, the plurality of pixel areas 400 are arranged along a direction in which the scan lines 100 are arranged; that is, the first direction described in the embodiment of the present application is the direction in which the plurality of scan lines 100 are arranged. The plurality of pixel units 300 in each of the pixel areas 400 are arranged along a direction in which the data lines 200 are arranged; that is, the second direction described in the embodiment of the present application is the direction in which the plurality of data lines 200 are arranged.

After obtaining relational data between a charging rate and charging time of the pixel units on each of the pixel areas in the embodiment of the present application, then, calculating an average charging time corresponding to a preset charging rate based on the relational data between the charging rate and the charging time of the pixel units on each of the pixel areas, then, obtaining an initial charging time of the pixel units on each of the pixel areas, and finally, adjusting the initial charging time of the pixel units on each of the pixel areas according to the average charging time, so that the initial charging time of the pixel units on each of the pixel areas is equal to the average charging time. Since the embodiment of the present application adjusts the initial charging time of the pixel units on each of the pixel areas based on the data of the relationship between the charging rate and the charging time of the pixel units on each of the pixel areas, the charging time of the pixel units on each of the pixel areas can be debugged, thereby improving display uniformity and improving the display quality of the display panel.

Figure 3:
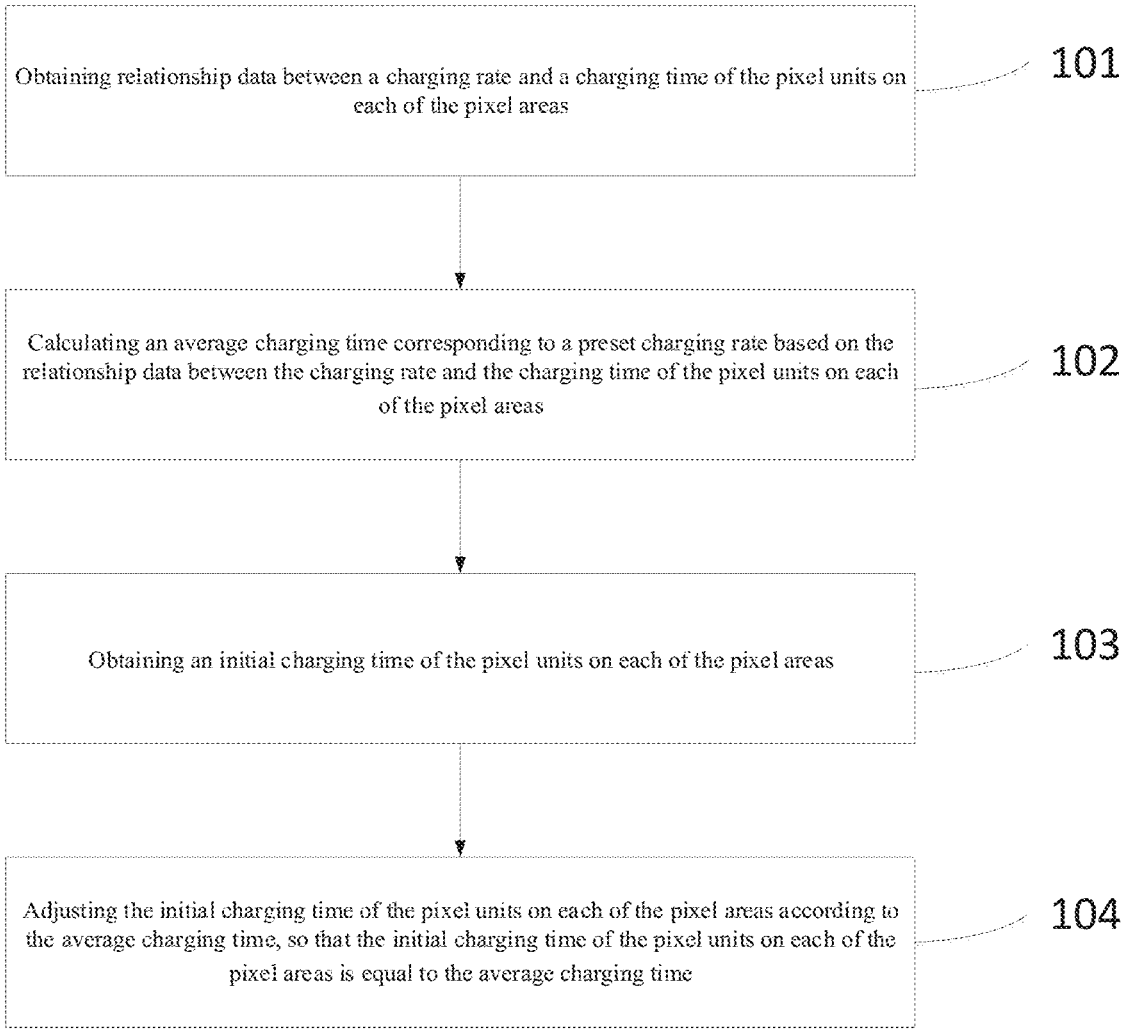
FIG. 3 is a schematic flowchart of the charging time modulating method provided by an embodiment of the present application.

Specifically, please refer to FIG. 3, which is a schematic flowchart of the charging time modulating method provided by an embodiment of the present application. As shown in FIG. 3, the specific process of the charging time modulating method may be as follows:

Step 101, obtaining relational data between a charging rate and a charging time of the pixel units on each of the pixel areas.

Among them, in the relational data between the charging rate and the charging time of the pixel units on a pixel area, the abscissa indicates the charging time, and the ordinate indicates an actual charging voltage of the pixel unit. It may be well known by those skilled in the art that an ideal charging voltage of one the pixel units when a pixel value of the pixel unit is 255 is 14.2V and a charging rate of the pixel unit refers to the ratio between the actual charging voltage and the ideal charging voltage of the pixel unit, so the relational data between the charging rate and the charging time of the pixel unit can be determined based on the actual charging voltage and the charging time of the pixel unit. For example, if the actual charging voltage of the pixel unit is 12.5V, then the charging rate of the pixel unit is 12.5/14.2, i.e., 88.03%.

In some embodiments, the step of obtaining the relational data between the charging rate and the charging time of the pixel units on each of the pixel areas comprises:

Step 1011, obtaining the charging time and the charging rate of each of the pixel units on each of the pixel areas.

Step 1012, according to the charging time and the charging rate of each of the pixel units on each of the pixel areas, generating the relational data between the charging rate and the charging time of the pixel units on the corresponding pixel area.

It should be noted that the charging time of a pixel unit refers to the time during which the pixel unit is charged. The charging rate of a pixel unit refers to the ratio between the actual charging voltage of the pixel unit and the ideal charging voltage. For example, in some embodiments, a pixel unit comprises a transistor, the gate of the transistor is connected to a corresponding scan line, the source of the transistor is connected to a corresponding data line, and the drain of the transistor is connected to the pixel electrode of the pixel unit. Among them, the scan line is used to access a scan signal, and the data line is used to access a data signal. If the transistor is an N-type transistor, the charging time of the pixel unit specifically refers to the time interval when the scan signal is at a high potential. If the transistor is a P-type transistor, the charging time of the pixel unit specifically refers to the time interval when the scan signal is at a high potential. In addition, if the voltage of the data signal is 10 volts and the voltage of the pixel unit is 8 volts after charging, the ideal charging voltage of the pixel unit is 10 volts, and the actual charging voltage of the pixel unit is 8 volts. The charging rate of the unit is 0.8.

In this embodiment of the present application, the charging rate of each of the pixel units on each of the pixel areas at different charging times can be detected or simulated, thereby generating the relational data between the charging rate and the charging time of the pixel units on each of the pixel areas. In the specific generation, for the same pixel area, the charging rate at each charging time obtained by detection or simulation can be marked in the corresponding data graph, and then the marked multiple points are generated into corresponding relational data by using the least square method. Of course, it can be understood that in some embodiments, the charging time and the corresponding charging rate of as many points as possible can be obtained by software simulation, so as to generate relational data as accurate as possible.

Figure 4:
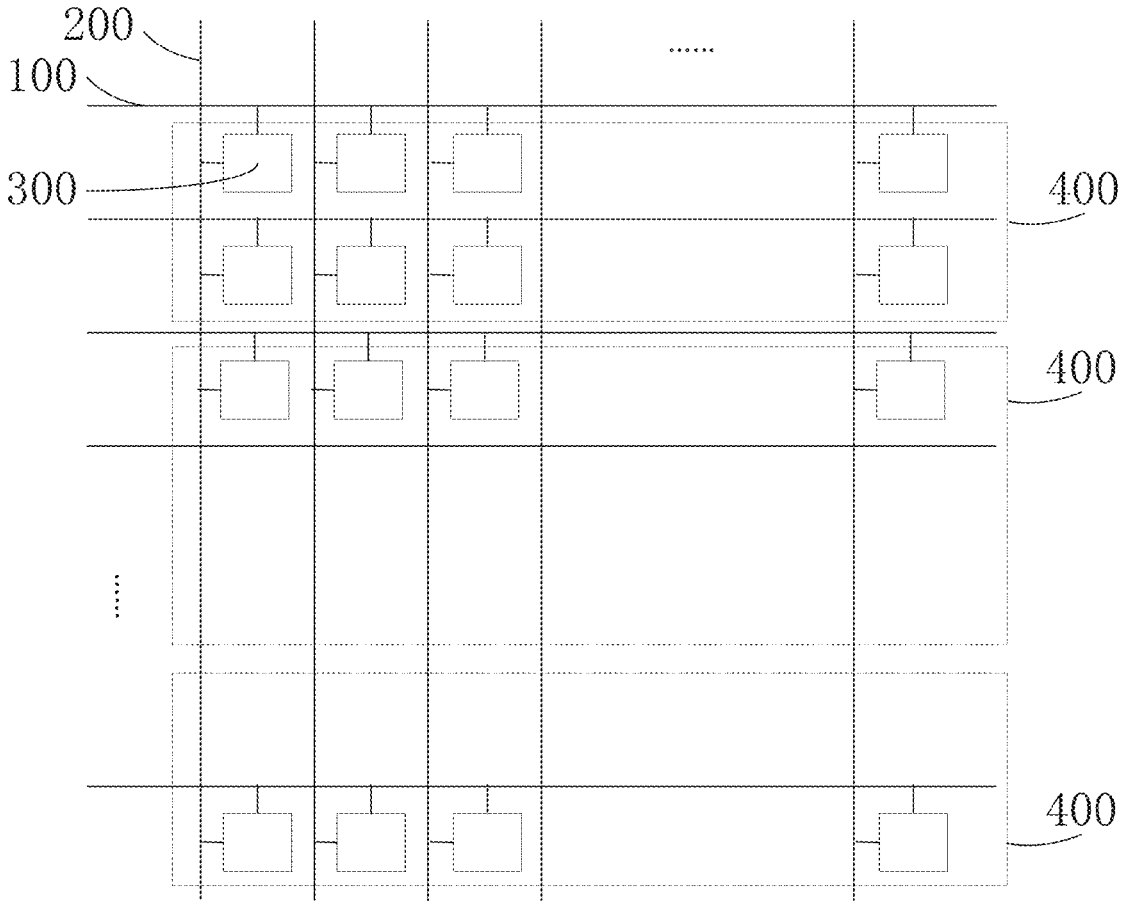
FIG. 4 is another schematic structural diagram of a display panel in a charging time modulating method provided by an embodiment of the present application.
Figure 5:
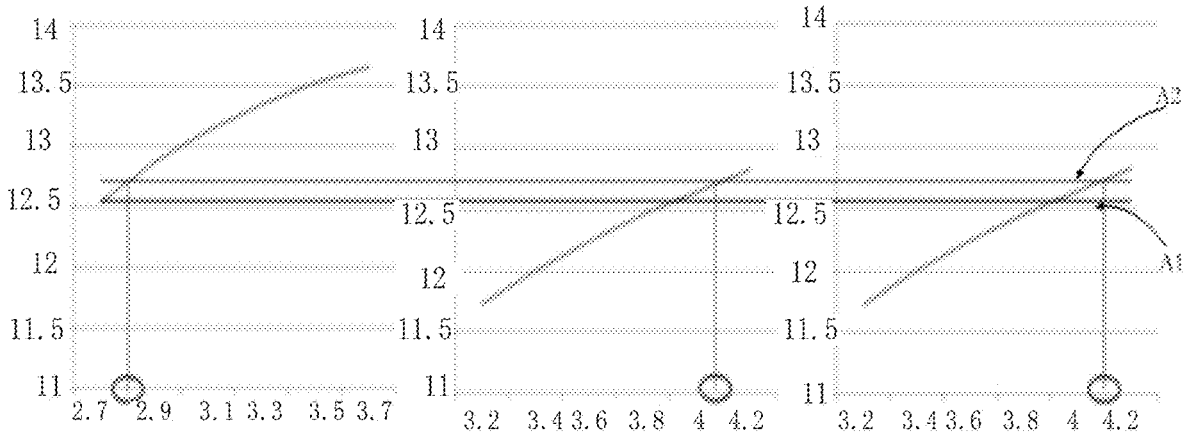
FIG. 5 is a schematic diagram showing a relationship between charging time and charging rate of pixel units on each pixel area in the charging time modulating method provided by an embodiment of the present application.

For example, the display panel is divided into three pixel areas as an example for description. Please refer to FIGS. 4 and 5. FIG. 4 is another schematic structural diagram of a display panel in a charging time modulating method provided by an embodiment of the present application. FIG. 5 is a schematic diagram showing the relationship between the charging time and the charging rate of the pixel units on each of the pixel areas in the charging time modulating method provided by the embodiment of the present application. The difference between the display panel shown in FIG. 4 and the display panel shown in FIG. 2 is that the display panel in FIG. 4 is only divided into three pixel areas 400. With reference to FIGS. 4 and 5, in the three data graphs in FIG. 5, the relational data in each data graph respectively describes the relationship between the charging time and the charging rate of the pixel units on the three different pixel areas 400 on the display panel shown in FIG. 4. For the relational data in each data graph, please refer to the description in step 101, which will not be described here.

Step 102, calculating an average charging time corresponding to a preset charging rate based on the relational data between the charging rate and the charging time of the pixel units on each of the pixel areas.

It can be understood that the average charging time corresponding to the preset charging rate means that the sum of the charging times corresponding to the preset charging rate in each pixel area is averaged. For example, the description will be made by taking the display panel divided into three pixel areas as an example. The charging time corresponding to the preset charging rate on the first pixel area can be obtained from the relational data between the charging rate of the pixel unit corresponding to the first pixel area and the charging time. The relational data between the charging rate and the charging time can be used to obtain the charging time corresponding to the preset charging rate on the second pixel area. The relational data between the charging rate and the charging time of the pixel unit corresponding to the third pixel area can be used to obtain the charging time corresponding to the preset charging rate on the third pixel area. The average of the three charging times is the average charging time.

In some embodiments, the step of calculating the average charging time corresponding to the preset charging rate based on the relational data between the charging rate and the charging time of the pixel units on each of the pixel areas comprises:

Step 1021, obtaining the preset charging rate.

Step 1022, obtaining the charging time corresponding to the preset charging rate of the pixel units on each of the pixel areas according to the relational data between the charging rate and the charging time of the pixel units on each of the pixel areas.

Step 1023, calculating the average charging time based on the charging time corresponding to the preset charging rate of the pixel units on each of the pixel areas.

For example, please continue to refer to FIG. 5, the preset charging rate can be set to 12.5. You can first make a reference line with a charging rate equal to the preset reference charging rate in the data graph of the relationship between the charging rate and the charging time of the pixel unit on the pixel area corresponding to each pixel area. Then, obtain the intersection point in the relational data graph between the charging rate and the charging time of the pixel unit on the pixel area corresponding to each pixel area of the reference line, and take the intersection point of the charging time corresponding to the intersection point as the pixel unit and the charging time corresponding to preset charging rate on each pixel area. Finally, the average of the three charging times is the average charging time.

Further, in some embodiments, the step of obtaining the preset charging rate comprises:

Step 10211, obtaining the preset reference charging rate.

Step 10212, when the relational data between the charging rate and the charging time of the pixel units on each of the pixel areas comprise the preset reference charging rate, taking the preset reference charging rate as the preset charging rate.

Step 10213, when the relational data between the charging rate and the charging time of the pixel units on at least one of the pixel areas do not comprise the preset reference charging rate, adjusting the preset reference charging rate, and returning to the step 10211.

It should be noted that the preset charging rate can be set according to actual needs, but in order to further improve display uniformity, it is necessary to ensure that the relational data between the preset charging rate and the charging rate of the pixel unit on each pixel area and the charging time has an intersection point. That is, the relational data between the charging rate and the charging time of the pixel units on each of the pixel areas comprises the preset reference charging rate.

Step 103, obtaining an initial charging time of the pixel units on each of the pixel areas.

Wherein, the initial charging time of the pixel unit on each pixel area should be obtained based on the theoretical value stored in the storage unit in advance. Of course, the initial charging time can be different for different pixel areas.

Step 104, adjusting the initial charging time of the pixel units on each of the pixel areas according to the average charging time, so that the initial charging time of the pixel units on each of the pixel areas is equal to the average charging time.

It should be noted that the embodiment of the present application aims to adjust the charging time of the pixel units on each of the pixel areas, thereby improving the display uniformity and the display quality of the display panel.

In some embodiments, the step of adjusting the initial charging time of the pixel units on each of the pixel areas according to the average charging time, so that the initial charging time of the pixel units on each of the pixel areas is equal to the average charging time, comprises:

Step 1041, comparing the initial charging time of the pixel units on each of the pixel areas with the average charging time.

Step 1042, when the initial charging time of the pixel units on the pixel area is less than the average charging time, increasing the initial charging time to obtain a compensation charging time, wherein the compensation charging time is equal to the average charging time.

Step 1043, when the initial charging time of the pixel units on the pixel area is greater than the average charging time, reducing the initial charging time to obtain the compensation charging time, and the compensation charging time is equal to the average charging time.

Wherein, the initial charging time of the pixel units on each of the pixel area is optimized and compensated based on the average charging time. For a pixel unit that takes longer than the average charging time, its charging time is gradually reduced until the adjusted initial charging time is equal to the average charging time. For a pixel unit that takes less than the average charging time, its charging time is gradually increased until the adjusted initial charging time is equal to the average charging time. As shown in FIG. 3, the straight line A2 represents the adjusted charging rate corresponding to each pixel area.

Figure 6:
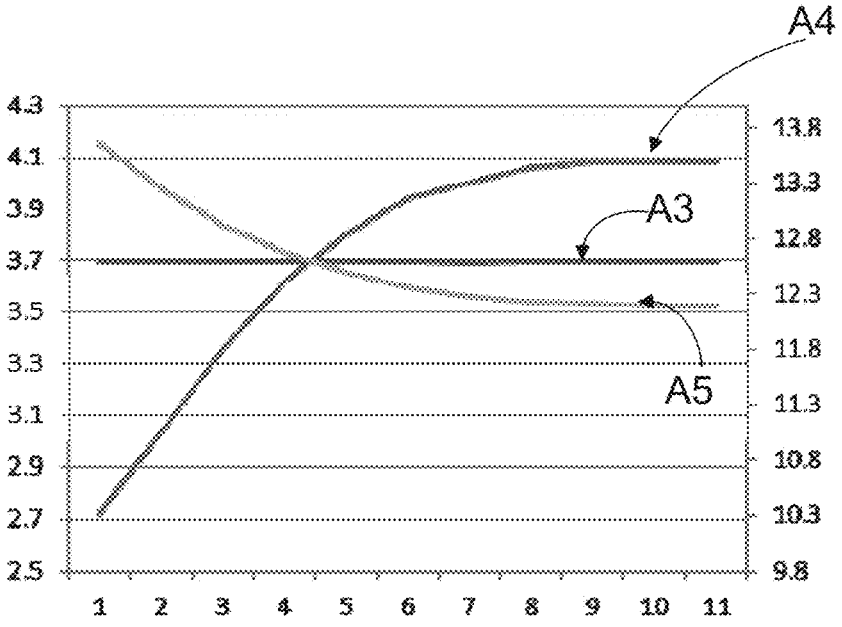
FIG. 6 is a comparison diagram before and after modulating in the charging time modulating method provided by an embodiment of the present application.

Please refer to FIG. 6. FIG. 6 is a comparison diagram before and after modulating in the charging time modulating method provided by the embodiment of the present application. As shown in FIG. 6, after the optimization compensation in step 104, the charging time corresponding to the pixel unit on each pixel area can be obtained. Among them, the data A3 is a data graph of the charging time after compensation. The data A4 is a data graph of the charging rate after compensation, and the data A5 is a data graph of the charging rate before compensation. It can be seen that the compensated data A4 is roughly in a straight line, and its vertical uniformity is good, indicating that the charging time of each pixel unit is approximately the same, thereby making the display more uniform and the display quality better.

After obtaining the relational data between the charging rate and the charging time of the pixel units on each of the pixel areas in the embodiment of the present application, then, calculating an average charging time corresponding to a preset charging rate based on the relational data between the charging rate and the charging time of the pixel units on each of the pixel areas, then, obtaining an initial charging time of the pixel units on each of the pixel areas, and finally, adjusting the initial charging time of the pixel units on each of the pixel areas according to the average charging time, so that the initial charging time of the pixel units on each of the pixel areas is equal to the average charging time. Since the embodiment of the present application adjusts the initial charging time of the pixel units on each of the pixel areas based on the data of the relationship between the charging rate and the charging time of the pixel units on each of the pixel areas, the charging time of the pixel units on each of the pixel areas can be debugged, thereby improving display uniformity and improving the display quality of the display panel.

Figure 7:
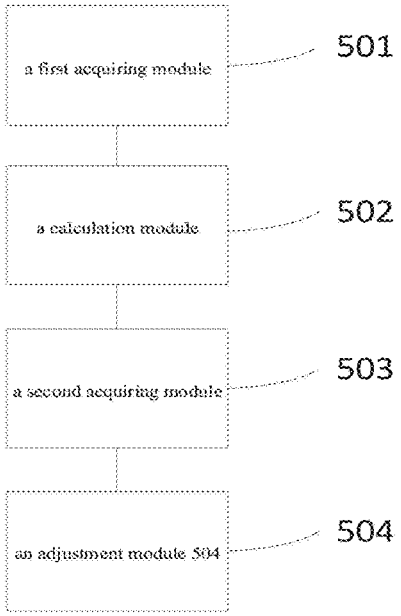
FIG. 7 is a schematic structural diagram of a charging time modulating device provided by an embodiment of the present application.

Please refer to FIG. 7, which is a schematic structural diagram of a charging time modulating device provided by an embodiment of the present application. Wherein, the charging time modulating device performs charging time modulation on the display panel. The display panel comprises a plurality of pixel areas arranged along the first direction, and each of the pixel areas comprises a plurality of pixel units arranged along the second direction. The charging time modulating device may comprise a first acquiring module 501, a calculation module 502, a second acquiring module 503, and an adjustment module 504, which may be as follows:

The first acquiring module 501 is configured to obtain relational data between a charging rate and a charging time of the pixel units on each of the pixel areas.

Wherein, in the relational data between the charging rate and the charging time of the pixel unit on a pixel area, the abscissa indicates the charging time, and the ordinate indicates an actual charging voltage of the pixel unit. It may be well known by those skilled in the art that an ideal charging voltage of one the pixel units when a pixel value of the pixel unit is 255 is 14.2V and a charging rate of the pixel unit refers to the ratio between the actual charging voltage and the ideal charging voltage of the pixel unit, so the relational data between the charging rate and the charging time of the pixel unit can be determined based on the actual charging voltage and the charging time of the pixel unit. For example, if the actual charging voltage of the pixel unit is 12.5V, then the charging rate of the pixel unit is 12.5/14.2, i.e., 88.03%.

Figure 8:
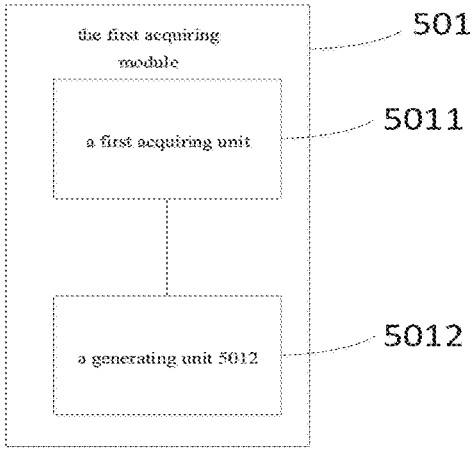
FIG. 8 is a schematic diagram of a first specific structure of a charging time modulating device provided by an embodiment of the present application.

In some embodiments, please refer to FIG. 8, which is a schematic diagram of a first specific structure of a charging time modulating device provided by an embodiment of the present application. As shown in FIG. 8, the first acquiring module 501 comprises a first acquiring unit 5011 and a generating unit 5012, which may be as follows:

The first acquiring unit 5011 is configured to obtain the charging time and the charging rate of each of the pixel units on each of the pixel areas.

The generating unit 5012 is configured to generate the relational data between the charging rate and the charging time of the pixel units on the corresponding pixel area according to the charging time and the charging rate of each of the pixel units on each of the pixel areas.

It should be noted that the charging time of a pixel unit refers to the time during which the pixel unit is charged. The charging rate of a pixel unit refers to the ratio between the actual charging voltage of the pixel unit and the ideal charging voltage. For example, in some embodiments, a pixel unit comprises a transistor, the gate of the transistor is connected to a corresponding scan line, the source of the transistor is connected to a corresponding data line, and the drain of the transistor is connected to the pixel electrode of the pixel unit. Among them, the scan line is used to access the scan signal, and the data line is used to access the data signal. If the transistor is an N-type transistor, the charging time of the pixel unit specifically refers to the time interval when the scan signal is at a high potential. If the transistor is a P-type transistor, the charging time of the pixel unit specifically refers to the time interval when the scan signal is at a high potential. In addition, if the voltage of the data signal is 10 volts and the voltage of the pixel unit is 8 volts after charging, the ideal charging voltage of the pixel unit is 10 volts, and the actual charging voltage of the pixel unit is 8 volts. The charging rate of the unit is 0.8.

In this embodiment of the present application, the charging rate of each of the pixel units on each of the pixel areas at different charging times can be detected or simulated, thereby generating the relational data between the charging rate and the charging time of the pixel units on each of the pixel areas. In the specific generation, for the same pixel area, the charging rate at each charging time obtained by detection or simulation can be marked in the corresponding data graph, and then the marked multiple points are generated into corresponding relational data by using the least square method. Of course, it can be understood that in some embodiments, the charging time and the corresponding charging rate of as many points as possible can be obtained by software simulation, so as to generate relational data as accurate as possible.

The calculation module 502 is configured to calculate an average charging time corresponding to a preset charging rate based on the relational data between the charging rate and the charging time of the pixel units on each of the pixel areas.

It can be understood that the average charging time corresponding to the preset charging rate means that the sum of the charging times corresponding to the preset charging rate in each pixel area is averaged.

Figure 9:
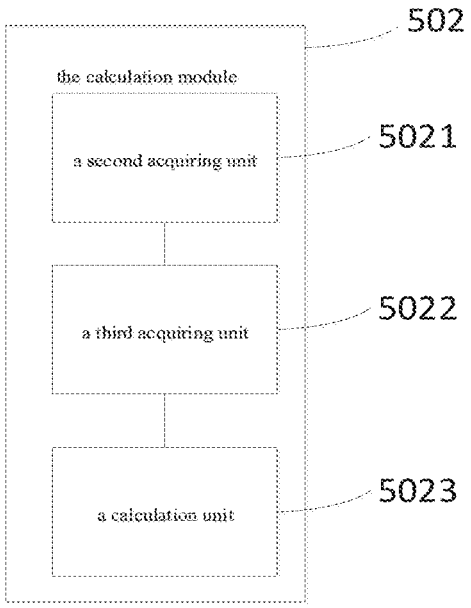
FIG. 9 is a schematic diagram of a second specific structure of a charging time modulating device provided by an embodiment of the present application.

In some embodiments, please refer to FIG. 9, which is a schematic diagram of a second specific structure of a charging time modulating device provided by an embodiment of the present application. As shown in FIG. 7, the calculation module 502 comprises a second acquiring unit 5021, a third acquiring unit 5022, and a calculation unit 5023, which may be as follows:

The second acquiring unit 5021 is configured to obtain the preset charging rate.

The third acquiring unit 5022 is configured to obtain the charging time corresponding to the preset charging rate of the pixel units on each of the pixel areas according to the relational data between the charging rate and the charging time of the pixel units on each of the pixel areas.

The calculation unit 5023 is configured to calculate the average charging time based on the charging time corresponding to the preset charging rate of the pixel units on each of the pixel areas.

Figure 10:
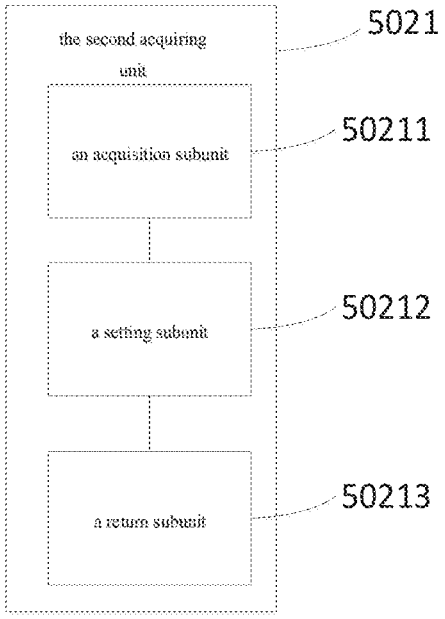
FIG. 10 is a schematic diagram of a third specific structure of a charging time modulating device provided by an embodiment of this application.

Further, in some embodiments, please refer to FIG. 10, which is a schematic diagram of a third specific structure of a charging time modulating device provided by an embodiment of this application. As shown in FIG. 8, the second acquiring unit 5021 comprises an acquisition subunit 50211, a setting subunit 50212, and a return subunit 50213, which may be as follows:

The acquiring subunit 50211 is configured to obtain the preset reference charging rate.

The setting subunit 50212 is configured to take the preset reference charging rate as the preset charging rate when the relational data between the charging rate and the charging time of the pixel units on each of the pixel areas comprise the preset reference charging rate.

The return subunit 50213 is configured to adjust the preset reference charging rate, and return to the acquiring subunit 50211 when the relational data between the charging rate and the charging time of the pixel units on at least one of the pixel areas do not comprise the preset reference charging rate.

It should be noted that the preset charging rate can be set according to actual needs, but in order to further improve the display uniformity, it is necessary to ensure that the relational data between the preset charging rate and the charging rate of the pixel unit on each pixel area and the charging time has an intersection point. That is, the relational data between the charging rate and the charging time of the pixel units on each of the pixel areas comprises the preset reference charging rate.

The second acquiring module 503 is configured to obtain an initial charging time of the pixel units on each of the pixel areas.

Wherein, the initial charging time of the pixel unit on each pixel area should be obtained based on the theoretical value stored in the storage unit in advance. Of course, the initial charging time can be different for different pixel areas.

The adjustment module 504 is used to adjust the initial charging time of the pixel units on each of the pixel areas according to the average charging time, so that the initial charging time of the pixel units on each of the pixel areas is equal to the average charging time.

It should be noted that the embodiment of the present application aims to adjust the charging time of the pixel units on each of the pixel areas, thereby improving the display uniformity and the display quality of the display panel.

Figure 11:
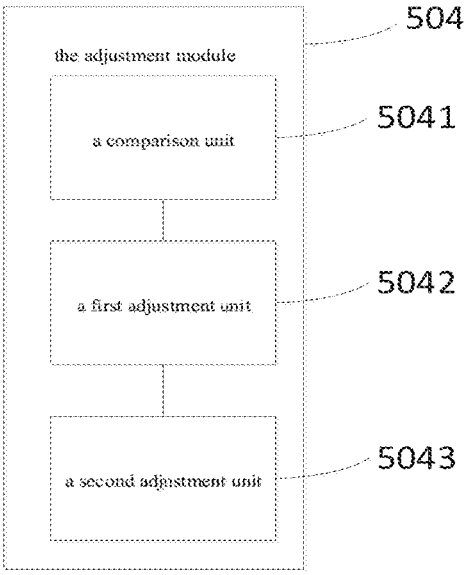
FIG. 11 is a schematic diagram of a fourth specific structure of a charging time modulating device provided by an embodiment of the present application.

In some embodiments, please refer to FIG. 11, which is a schematic diagram of a fourth specific structure of a charging time modulating device provided by an embodiment of the present application. As shown in FIG. 11, the adjustment module 504 comprises a comparison unit 5041, a first adjustment unit 5042, and a second adjustment unit 5043, which may be as follows:

The comparison unit 5041 is configured to compare the initial charging time of the pixel units on each of the pixel areas with the average charging time.

The first adjustment unit 5042 is configured to increase the initial charging time to obtain a compensation charging time when the initial charging time of the pixel units on the pixel area is less than the average charging time, and the compensation charging time is equal to the average charging time.

The second adjustment unit 5043 is configured to reduce the initial charging time to obtain the compensation charging time when the initial charging time of the pixel units on the pixel area is greater than the average charging time, and the compensation charging time is equal to the average charging time.

Wherein, the initial charging time of the pixel units on each of the pixel area is optimized and compensated based on the average charging time. For a pixel unit that takes longer than the average charging time, its charging time is gradually reduced until the adjusted initial charging time is equal to the average charging time. For a pixel unit that takes less than the average charging time, its charging time is gradually increased until the adjusted initial charging time is equal to the average charging time.

After obtaining the relational data between the charging rate and the charging time of the pixel units on each of the pixel areas in the embodiment of the present application, then, calculating an average charging time corresponding to a preset charging rate based on the relational data between the charging rate and the charging time of the pixel units on each of the pixel areas, then, obtaining an initial charging time of the pixel units on each of the pixel areas, and finally, adjusting the initial charging time of the pixel units on each of the pixel areas according to the average charging time, so that the initial charging time of the pixel units on each of the pixel areas is equal to the average charging time. Since the embodiment of the present application adjusts the initial charging time of the pixel units on each of the pixel areas based on the data of the relationship between the charging rate and the charging time of the pixel units on each of the pixel areas, the charging time of the pixel units on each of the pixel areas can be debugged, thereby improving display uniformity and improving the display quality of the display panel.

Figure 12:
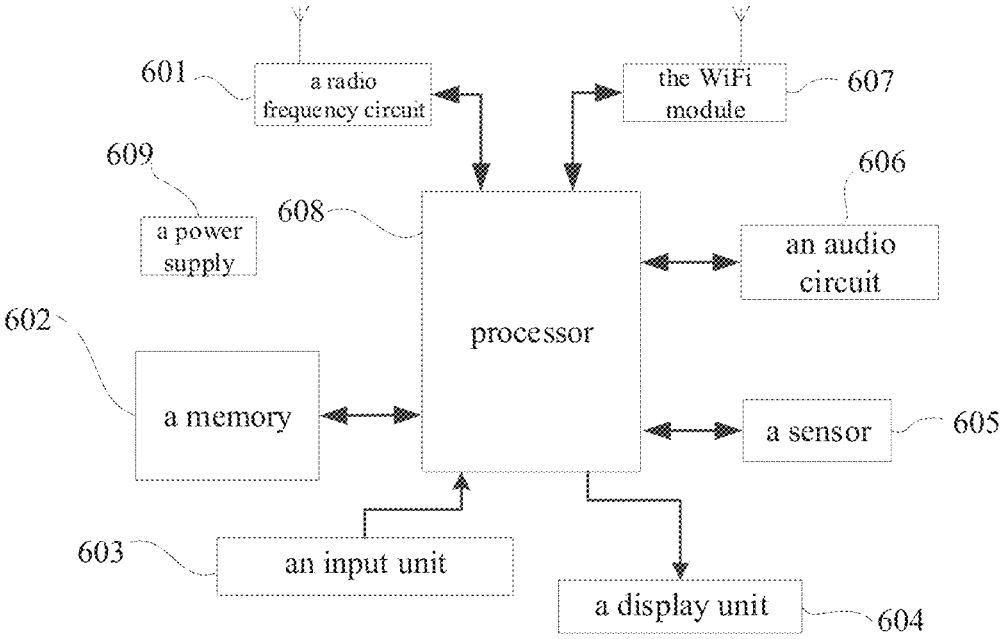
FIG. 12 is a schematic structural diagram of an electronic device provided by an embodiment of the present application.

Correspondingly, the embodiments of the present application also provide an electronic device. As shown in FIG. 12, the electronic device may comprise a radio frequency (RF) circuit 601, a memory 602 including one or more computer-readable storage media, an input unit 603, a display unit 604, a sensor 605, an audio circuit 606, a wireless fidelity (WiFi) module 607, a processor 608 including one or more processing cores, and a power supply 609 and other components. Those skilled in the art may understand that the terminal structure shown in FIG. 12 does not constitute a limitation on the terminal, and may comprise more or fewer components than those illustrated, or combine certain components, or arrange different components.

Wherein, the RF circuit 601 can be used to receive and send signals during the sending and receiving of information or during a call. In particular, after receiving the downlink information of a base station, it is handed over to one or more processors 608; in addition, the data related to the uplink is sent to the base station. Generally, the RF circuit 601 comprises, but is not limited to, an antenna, at least one amplifier, a tuner, one or more oscillators, a subscriber identity module (SIM) card, a transceiver, a coupler, a low-noise amplifier (LNA), duplexer, etc. In addition, the RF circuit 601 can also communicate with other devices via a wireless communication network. The wireless communication may use any communication standard or protocol, including but not limited to Global System for Mobile Communication (GSM), General Packet Radio Service (GPRS), Code Division Multiple Access (CDMA), Wideband Code Division Multiple Access (WCDMA), Long Term Evolution (LTE), E-mail, Short Messaging Service (SMS), etc.

The memory 602 may be used to store software programs and modules. The processor 608 executes various functional applications and data processing by running the software programs and modules stored in the memory 602. The memory 602 may mainly comprise a storage program area and a storage data area, wherein the storage program area may store an operating system, application programs required by at least one function (such as a sound playback function, an image playback function, etc.), and more. The storage data area may store the data created by the use of the terminal (such as audio data, phone book, etc.), and more. In addition, the memory 602 may comprise a high-speed random access memory, and may also comprise a non-volatile memory, such as at least one magnetic disk storage device, a flash memory device, or other volatile solid-state storage devices. Accordingly, the memory 602 may further comprise a memory controller to provide access to the memory 602 by the processor 608 and the input unit 603.

The input unit 603 can be used to receive input digital or character information, and generate keyboard, mouse, joystick, optical or trackball signal inputs related to user settings and function control. Specifically, in a specific embodiment, the input unit 603 may comprise a touch-sensitive surface and other input devices. A touch-sensitive surface, also known as a touch screen or touchpad, can collect user touch operations on or near it (for example, the user uses any suitable objects or accessories such as fingers, stylus, etc. on the touch-sensitive surface or touch-sensitive operation near the surface), and drive the corresponding connection device according to the preset program. Optionally, the touch-sensitive surface may comprise a touch detection device and a touch controller. Wherein, the touch detection device detects the user's touch orientation, detects the signal brought by the touch operation, and transmits the signal to the touch controller; the touch controller receives touch information from the touch detection device, and converts it into contact coordinates, and then sends it to the processor 608, and can receive the command sent by the processor 608 and execute it. In addition, a variety of types such as resistive, capacitive, infrared, and surface acoustic waves can be used to implement touch-sensitive surfaces. In addition to the touch-sensitive surface, the input unit 603 may also comprise other input devices. Specifically, other input devices may comprise, but are not limited to, one or more of a physical keyboard, function keys (such as volume control keys, switch keys, etc.), trackball, mouse, joystick, and so on.

The display unit 604 can be used to display information input by the user or information provided to the user and various graphical user interfaces of the terminal. These graphical user interfaces can be composed of graphics, text, icons, video, and any combination thereof. The display unit 604 may comprise a display panel. Alternatively, the display panel may be configured in the form of a liquid crystal display (LCD), an organic light-emitting diode (OLED), or the like. Further, the touch-sensitive surface may cover the display panel, and when the touch-sensitive surface detects a touch operation on or near it, it is transmitted to the processor 608 to determine the type of touch event, and then the processor 608 displays on the display according to the type of touch event. The corresponding visual output is provided on the panel. Although in FIG. 12, the touch-sensitive surface and the display panel are implemented as two independent components to realize the input and input functions, in some embodiments, the touch-sensitive surface and the display panel may be integrated to realize the input and output functions.

The electronic device may further comprise at least one sensor 605, such as a light sensor, a motion sensor, and other sensors. Specifically, the light sensor may comprise an ambient light sensor and a proximity sensor, wherein the ambient light sensor may adjust the brightness of the display panel according to the brightness of the ambient light, and the proximity sensor may turn off the display panel and/or the backlight when the terminal moves to the ear. As a kind of motion sensor, the gravity acceleration sensor can detect the magnitude of acceleration in various directions (generally three axes), and can detect the magnitude and direction of gravity when at rest, and can be used to identify the gestures of mobile phones (such as horizontal and vertical screen switching, related games, magnetometer posture calibration), vibration recognition related functions (such as pedometer, tap), etc. As for other sensors that can be configured on the terminal, such as gyroscopes, barometers, hygrometers, thermometers, infrared sensors, etc., they shall not be repeated hereafter.

The audio circuit 606, the speaker, and the microphone can provide an audio interface between the user and the terminal. The audio circuit 606 can transmit the converted electrical signal of the received audio data to the speaker, which converts it into a sound signal output; on the other hand, the microphone converts the collected sound signal into an electrical signal, which is converted by the audio circuit 606 into audio data after being received. After the audio data is processed by the audio data output processor 608, it is sent to, for example, another terminal through the RF circuit 601, or the audio data is output to the memory 602 for further processing. The audio circuit 606 may also comprise an earplug jack to provide communication between the peripheral headset and the terminal.

WiFi is a short-range wireless transmission technology. The terminal can help users send and receive emails, browse web pages, and access streaming media through the WiFi module 607. It provides users with wireless broadband Internet access. Although FIG. 12 shows the WiFi module 607, it can be understood that it is not an essential component of the terminal, and can be omitted without changing the scope of the essence of the application as needed.

The processor 608 is the control center of the terminal, connects various parts of the entire mobile phone with various interfaces and lines, runs or executes software programs and/or modules stored in the memory 602, and calls data stored in the memory 602 to execute various functions and processing data of the terminal, so as to monitor the mobile phone as a whole. Optionally, the processor 608 may comprise one or more processing cores; preferably, the processor 608 may integrate an application processor and a modem processor, wherein the application processor mainly processes an operating system, a user interface, and application programs, etc. The modem processor mainly handles wireless communication. It can be understood that the above-mentioned modem processor may not be integrated into the processor 608.

The electronic device further comprises a power supply 609 (such as a battery) that supplies power to various components. Preferably, the power supply can be logically connected to the processor 608 through the power management system, so as to implement functions such as charging, discharging, and power management through the power management system. The power supply 609 may also comprise any component such as one or more DC or AC power supplies, a recharging system, a power failure detection circuit, a power converter or inverter, and a power status indicator.

Although not shown, the electronic device may also comprise a camera, a Bluetooth module, and so on, which will not be repeated here. Specifically in this embodiment, the processor 608 in the electronic device loads the executable file corresponding to the process of one or more application programs into the memory 602 according to the following instructions, and the processor 608 runs and stores the application program in the memory 602 to realize various functions:

After obtaining the relational data between the charging rate and the charging time of the pixel units on each of the pixel areas in the embodiment of the present application, an average charging time corresponding to a preset charging rate is calculated based on the relational data between the charging rate and the charging time of the pixel units on each of the pixel areas, an initial charging time of the pixel units on each of the pixel areas is obtained, and the initial charging time of the pixel units on each of the pixel areas is adjusted according to the average charging time, so that the initial charging time of the pixel units on each of the pixel areas is equal to the average charging time.

After obtaining the relational data between the charging rate and the charging time of the pixel units on each of the pixel areas in the embodiment of the present application, then, calculating an average charging time corresponding to a preset charging rate based on the relational data between the charging rate and the charging time of the pixel units on each of the pixel areas, then, obtaining an initial charging time of the pixel units on each of the pixel areas, and finally, adjusting the initial charging time of the pixel units on each of the pixel areas according to the average charging time, so that the initial charging time of the pixel units on each of the pixel areas is equal to the average charging time. Since the embodiment of the present application adjusts the initial charging time of the pixel units on each of the pixel areas based on the data of the relationship between the charging rate and the charging time of the pixel units on each of the pixel areas, the charging time of the pixel units on each of the pixel areas can be debugged, thereby improving display uniformity and improving the display quality of the display panel.

Those of ordinary skill in the art may understand that all or part of the steps in the various methods of the above embodiments may be completed by instructions, or by controlling related hardware by instructions, and the instructions may be stored in a computer-readable storage medium, and is loaded and executed by the processor.

To this end, an embodiment of the present application provides a storage medium in which multiple instructions are stored, and the instruction can be loaded by a processor to perform steps in any of the charging time modulating methods provided in the embodiments of the present application. For example, the instruction can perform the following steps:

After obtaining the relational data between the charging rate and the charging time of the pixel units on each of the pixel areas in the embodiment of the present application, an average charging time corresponding to a preset charging rate is calculated based on the relational data between the charging rate and the charging time of the pixel units on each of the pixel areas, an initial charging time of the pixel units on each of the pixel areas is obtained, and the initial charging time of the pixel units on each of the pixel areas is adjusted according to the average charging time, so that the initial charging time of the pixel units on each of the pixel areas is equal to the average charging time.

The specific implementation of the above operations can refer to the previous embodiments, and will not be repeated here.

The storage medium may comprise: read only memory (ROM), random access memory (RAM), magnetic disk, or optical disk.

Since the instructions stored in the storage medium can perform the steps in any of the charging time modulating methods provided in the embodiments of the present application, therefore, any of the charging time modulating methods provided in the embodiments of the present application can be implemented. For the beneficial effects achieved, please refer to the previous embodiments for details, which will not be repeated here.

The charging time modulating method, device, storage medium, and electronic equipment provided by the embodiments of the present application are described in detail above, and specific examples are used in this article to explain the principles and implementation modes of the present application. It is only used to help understand the method and core ideas of this application; meanwhile, for those skilled in the art, according to the ideas of this application, there will be changes in the specific implementation and application scope. In summary, the content of the description should not be construed as limiting the application.

What is claimed is:

1. A charging time modulating method, configured to modulate charging time of a display panel, wherein the display panel comprises a plurality of pixel areas arranged along a first direction, and each of the pixel areas comprises a plurality of pixel units arranged along a second direction, wherein the charging time modulating method comprises steps of:

obtaining relational data between a charging rate and a charging time of the pixel units on each of the pixel areas;

calculating an average charging time corresponding to a preset charging rate based on the relational data between the charging rate and the charging time of the pixel units on each of the pixel areas;

obtaining an initial charging time of the pixel units on each of the pixel areas; and adjusting the initial charging time of the pixel units on each of the pixel areas according to the average charging time, so that the initial charging time of the pixel units on each of the pixel areas is equal to the average charging time;

wherein the step of obtaining the relational data between the charging rate and the charging time of the pixel units on each of the pixel areas comprises:

obtaining the charging time and the charging rate of each of the pixel units on each of the pixel areas; and according to the charging time and the charging rate of each of the pixel units on each of the pixel areas, generating the relational data between the charging rate and the charging time of the pixel units on the corresponding pixel area; and the step of calculating the average charging time corresponding to the preset charging rate based on the relational data between the charging rate and the charging time of the pixel units on each of the pixel areas comprises:

obtaining the preset charging rate;

obtaining a charging time corresponding to the preset charging rate of the pixel units on each of the pixel areas according to the relational data between the charging rate and the charging time of the pixel units on each of the pixel areas; and calculating the average charging time based on the charging time corresponding to the preset charging rate of the pixel units on each of the pixel areas.

2. The charging time modulating method of claim 1, wherein the step of obtaining the preset charging rate comprises:

obtaining a preset reference charging rate;

when the relational data between the charging rate and the charging time of the pixel units on each of the pixel areas comprise the preset reference charging rate, taking the preset reference charging rate as the preset charging rate; and when the relational data between the charging rate and the charging time of the pixel units on at least one of the pixel areas do not comprise the preset reference charging rate, adjusting the preset reference charging rate, and returning to the step of obtaining the preset reference charging rate.

3. The charging time modulating method of claim 1, wherein the step of adjusting the initial charging time of the pixel units on each of the pixel areas according to the average charging time, so that the initial charging time of the pixel units on each of the pixel areas is equal to the average charging time, comprises:

comparing the initial charging time of the pixel units on each of the pixel areas with the average charging time;

when the initial charging time of the pixel units on the pixel area is less than the average charging time, increasing the initial charging time to obtain a compensation charging time, wherein the compensation charging time is equal to the average charging time; and when the initial charging time of the pixel units on the pixel area is greater than the average charging time, reducing the initial charging time to obtain the compensation charging time, and the compensation charging time is equal to the average charging time.

4. A charging time modulating method, configured to modulate charging time of a display panel, wherein the display panel comprises a plurality of pixel areas arranged along a first direction, and each of the pixel areas comprises a plurality of pixel units arranged along a second direction, wherein the charging time modulating method comprises steps of:

obtaining relational data between a charging rate and a charging time of the pixel units on each of the pixel areas;

calculating an average charging time corresponding to a preset charging rate based on the relational data between the charging rate and the charging time of the pixel units on each of the pixel areas;

obtaining an initial charging time of the pixel units on each of the pixel areas; and adjusting the initial charging time of the pixel units on each of the pixel areas according to the average charging time, so that the initial charging time of the pixel units on each of the pixel areas is equal to the average charging time.

5. The charging time modulating method of claim 4, wherein the step of obtaining the relational data between the charging rate and the charging time of the pixel units on each of the pixel areas comprises:

obtaining the charging time and the charging rate of each of the pixel units on each of the pixel areas; and according to the charging time and the charging rate of each of the pixel units on each of the pixel areas, generating the relational data between the charging rate and the charging time of the pixel units on the corresponding pixel area.

6. The charging time modulating method of claim 4, wherein the step of calculating the average charging time corresponding to the preset charging rate based on the relational data between the charging rate and the charging time of the pixel units on each of the pixel areas comprises:

obtaining the preset charging rate;

obtaining a charging time corresponding to the preset charging rate of the pixel units on each of the pixel areas according to the relational data between the charging rate and the charging time of the pixel units on each of the pixel areas; and calculating the average charging time based on the charging time corresponding to the preset charging rate of the pixel units on each of the pixel areas.

7. The charging time modulating method of claim 6, wherein the step of obtaining the preset charging rate comprises:

obtaining a preset reference charging rate;

when the relational data between the charging rate and the charging time of the pixel units on each of the pixel areas comprise the preset reference charging rate, taking the preset reference charging rate as the preset charging rate; and when the relational data between the charging rate and the charging time of the pixel units on at least one of the pixel areas do not comprise the preset reference charging rate, adjusting the preset reference charging rate, and returning to the step of obtaining the preset reference charging rate.

8. The charging time modulating method of claim 4, wherein the step of adjusting the initial charging time of the pixel units on each of the pixel areas according to the average charging time, so that the initial charging time of the pixel units on each of the pixel areas is equal to the average charging time, comprises:

comparing the initial charging time of the pixel units on each of the pixel areas with the average charging time;

when the initial charging time of the pixel units on the pixel area is less than the average charging time, increasing the initial charging time to obtain a compensation charging time, wherein the compensation charging time is equal to the average charging time; and when the initial charging time of the pixel units on the pixel area is greater than the average charging time, reducing the initial charging time to obtain the compensation charging time, and the compensation charging time is equal to the average charging time.

9. A non-transitory computer readable storage medium, storing a computer program thereon that, when executed by a processor, perform a charging time modulating method configured to modulate charging time of a display panel, wherein the display panel comprises a plurality of pixel areas arranged along a first direction, and each of the pixel areas comprises a plurality of pixel units arranged along a second direction, wherein the charging time modulating method comprises:

obtaining relational data between a charging rate and a charging time of the pixel units on each of the pixel areas;

calculating an average charging time corresponding to a preset charging rate based on the relational data between the charging rate and the charging time of the pixel units on each of the pixel areas;

obtaining an initial charging time of the pixel units on each of the pixel areas; and adjusting the initial charging time of the pixel units on each of the pixel areas according to the average charging time, so that the initial charging time of the pixel units on each of the pixel areas is equal to the average charging time.

10. The storage medium of claim 9, wherein the obtaining relational data between a charging rate and a charging time of the pixel units on each of the pixel areas comprises:

obtaining the charging time and the charging rate of each of the pixel units on each of the pixel areas; and generating the relational data between the charging rate and the charging time of the pixel units on the corresponding pixel area according to the charging time and the charging rate of each of the pixel units on each of the pixel areas.

11. The storage medium of claim 9, wherein the calculating an average charging time corresponding to a preset charging rate based on the relational data between the charging rate and the charging time of the pixel units on each of the pixel areas comprises:

obtaining the preset charging rate;

obtaining a charging time corresponding to the preset charging rate of the pixel units on each of the pixel areas according to the relational data between the charging rate and the charging time of the pixel units on each of the pixel areas; and calculating the average charging time based on the charging time corresponding to the preset charging rate of the pixel units on each of the pixel areas.

12. The storage medium of claim 11, wherein the obtaining an initial charging time of the pixel units on each of the pixel areas comprises:

obtaining a preset reference charging rate;

taking the preset reference charging rate as the preset charging rate when the relational data between the charging rate and the charging time of the pixel units on each of the pixel areas comprise the preset reference charging rate; and adjusting the preset reference charging rate, and return to the acquiring subunit when the relational data between the charging rate and the charging time of the pixel units on at least one of the pixel areas do not comprise the preset reference charging rate.

13. The storage medium of claim 9, wherein the adjusting the initial charging time of the pixel units on each of the pixel areas according to the average charging time comprises:

comparing the initial charging time of the pixel units on each of the pixel areas with the average charging time;

increasing the initial charging time to obtain a compensation charging time when the initial charging time of the pixel units on the pixel area is less than the average charging time, and the compensation charging time is equal to the average charging time; and reducing the initial charging time to obtain the compensation charging time when the initial charging time of the pixel units on the pixel area is greater than the average charging time, and the compensation charging time is equal to the average charging time.

* * * * *